US011774199B2

(12) United States Patent
Malichen-Snyder

(10) Patent No.: US 11,774,199 B2
(45) Date of Patent: Oct. 3, 2023

(54) REMOTELY ACTIVATED FIREARM SAFETY ACCESSORY

(71) Applicant: Thomas Joseph Malichen-Snyder, Kingston (CA)

(72) Inventor: Thomas Joseph Malichen-Snyder, Kingston (CA)

( * ) Notice: Subject to any disclaimer, the term of this patent is extended or adjusted under 35 U.S.C. 154(b) by 0 days.

(21) Appl. No.: 17/367,819

(22) Filed: Jul. 6, 2021

(65) Prior Publication Data

US 2023/0010591 A1 Jan. 12, 2023

(51) Int. Cl.
*F41A 17/06* (2006.01)
*F41A 17/54* (2006.01)

(52) U.S. Cl.
CPC ..... *F41A 17/06* (2013.01); *F41A 17/54* (2013.01)

(58) Field of Classification Search
CPC ..... F41A 17/06; F41A 17/56
USPC ..... 42/70.11
See application file for complete search history.

(56) References Cited

U.S. PATENT DOCUMENTS

2014/0230300 A1* 8/2014 Haq ..... F41A 17/54 42/70.06
2014/0290110 A1* 10/2014 Stewart ..... F41A 17/46 42/70.11
2014/0360073 A1* 12/2014 Stewart ..... F41A 17/08 42/70.11

* cited by examiner

*Primary Examiner* — Samir Abdosh

(57) ABSTRACT

The invention relates to an electronic device that is used to block the accessibility of a firearms Trigger. Wherein an electronic device is mounted on a rail or rail accessory and is locked in place using security screws and tamper proof fasteners allowing the device to fit an array of single action and striker-fired handguns. The security screws are in place to stop easy removal unless the possessor has the proper tool to remove them. The device its self uses a battery to operate and picks up a transmission broadcasted from a Bluetooth within its programmed range by the use of a Bluetooth proximity detector. Once the transmission has been picked up it activates its locking mechanism in the form of a solenoid causing its pin to lift and allows a slide placed In front of the trigger acting as a second trigger to move back and forth allowing the movement of the firearms trigger. The slide is moved back its original position by the use of a spring. When the Bluetooth is out of the device's proximity detectors programmed range the solenoid returns to its locked state stopping access to the trigger. Making the trigger locking device a beneficial reusable safety device.

12 Claims, 7 Drawing Sheets

REMOTELY ACTIVATED FIREARM SAFETY ACCESSORY

BACKGROUND OF THE INVENTION

Field of the Invention

The invention generally relates too a firearm safety device in the form of a self-locking slide acting as a second trigger, mounted in front and against the sides of the firearms trigger by the use of a rail or rail accessory allowing compatibility to a wide variety of single action and striker-fired handguns. It is activated by a Bluetooth proximity detector picking up a broadcast transmission signal from a worn Bluetooth device, thus signaling a magnetic solenoid pin to raise allowing the user to pull the slide that was acting as a second trigger denying access to the firearms trigger, against the firearms trigger discharging their firearm. A spring pushes the slide acting as the second trigger back into position when the trigger is released or not under pressure. The devices solenoid relocks the use of the slide acting as a second trigger when the Bluetooth is out of the Bluetooth proximity detectors predetermined range.

Background

Some attempted solutions have tried finger print detection, barrel locks that discharge with a turning combination and RFID embedded hand grips that control the firing pins, but this has not sufficiently addressed the needs of the firearms safety industry owing to the needed modifications to the gun, usability issues such as only being compatible with a few models, or the lock was designed to discharge or fall off providing no lasting safety from someone else using the owners weapon against them.

SUMMARY

This invention relates to a method and means of a trigger locking device for firearm safety purposes. This trigger locking device uses electronic and mechanical parts. The device works by the use of a Bluetooth proximity detector, solenoid, mercury switch and spring-loaded slide that acts as an open trigger cover obstructing the trigger from the front and sides but not behind allowing your trigger to be accessible with the ability to put your finger around it but inoperable. The device is powered by rechargeable lithium-ion batteries. The Bluetooth proximity detector operates the solenoid and unlocks it indefinitely until a Bluetooth broadcast transmission is broken at which point the solenoid would relock the spring-loaded slide again. The proximity detector connects with a Bluetooth enabled wrist worn device worn by the user, and will connect within a predetermined distance of foot or less of the safety device containing the proximity detector. The device as a whole does not have an accessible on and off switch instead it relies on a mercury switch which uses gravity to turn itself on and off depending on the position the device is in, in this instance while on one of its sides, pointed down or holstered it would remain turned off but when drawn and leveled to a certain degree it would turn on, on its own and activate the proximity detector to indefinitely search for its pre-set Bluetooth connection. The proximity detector will only be programmed to operate when the Bluetooth device being used specifically for the safety device is in range, stopping the possibility of other Bluetooth devices from interfering or unlocking the slide controlling the trigger on the firearm.

The device is attached to a firearm though the use of a picatinny, weaver gun rail, or gun rail attachment and is fastened by the use of a beveled snake eye security screw and a beveled snake eye security bolt, thus making removal without its specific tool extremely difficult.

The purpose of this Invention is safety. One main advantage of the invention is to protect concealment or open carry users, particularly in civilian use, from being hurt by their own firearm. For example, someone where to attack a carrier overpower them and take control of their firearm, or the carrier drew their weapon but decided not to shoot and the attacker gained control of the weapon, the carrier could decide to run or fight while the attacker tried to operate their weapon unsuccessfully, thus potentially saving ethers lives. Another advantage is around young children the device would be inoperable without serious intent and knowledge of operation, time, effort, and resources not typical of young children. These are just some examples of its purpose and benefits however one large advantage that should be empathized is animosity, this device and its compatible wrist worn Bluetooth alone in no way will store information about the user or their location or activities related to their firearm in any term or personal movements, it is merely capable of stopping the ability to pull a trigger and can be removed from the rail of the firearm or rail accessory on the firearm at any time using the security screw tools provided. This invention is meant to operate on all single action and striker fired handguns giving it a wide array of compatibility.

DETAILED DESCRIPTION OF DRAWINGS

Figure 1:
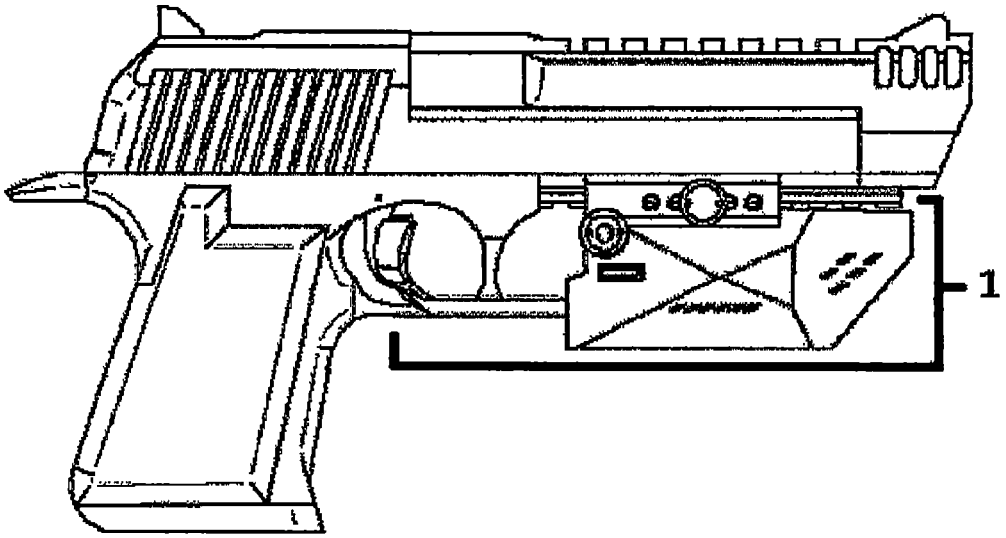
FIG. 1 depicts the device attached to a handgun rail.
Figure 2:
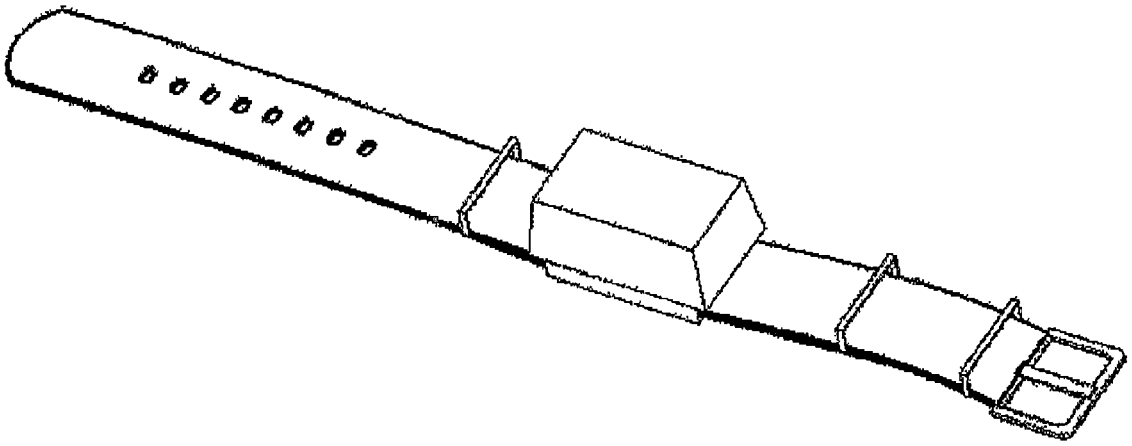
FIG. 2 depicts the rechargeable Bluetooth bracelet.
Figure 3:
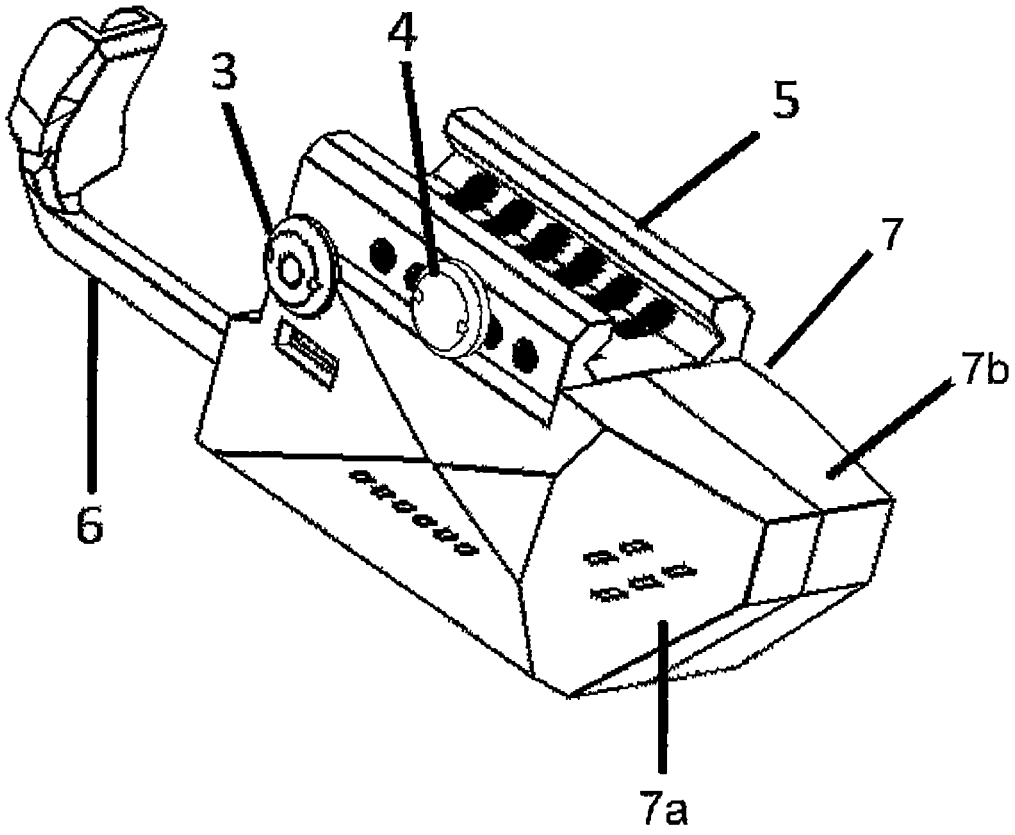
FIG. 3 depicts a perspective view of the device.
Figure 4:
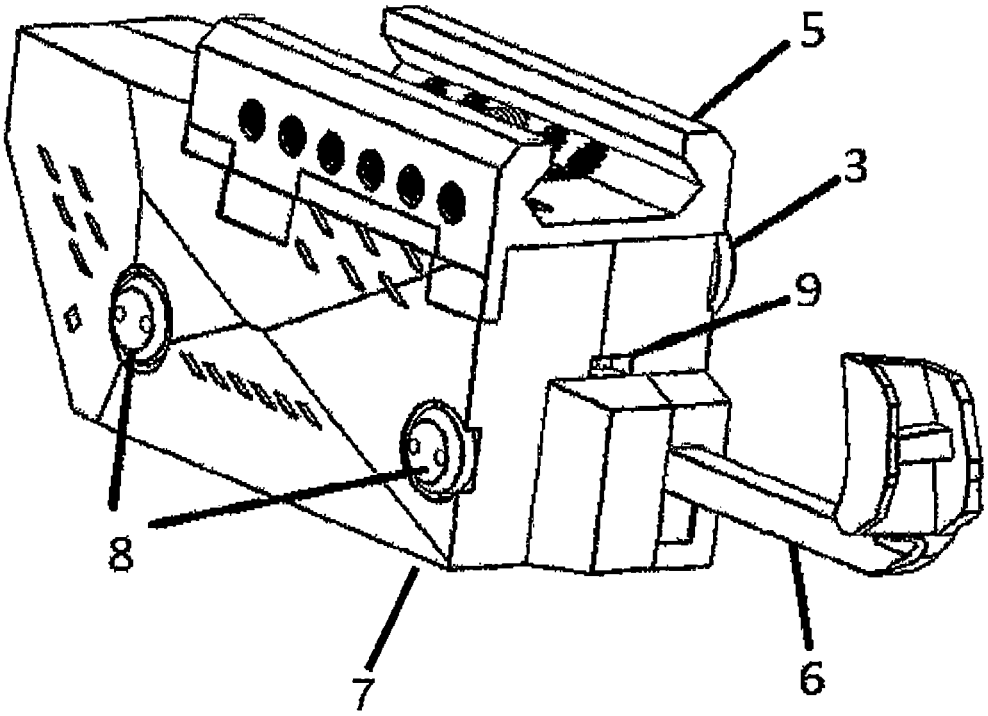
FIG. 4 another perspective view of the device.
Figure 5:
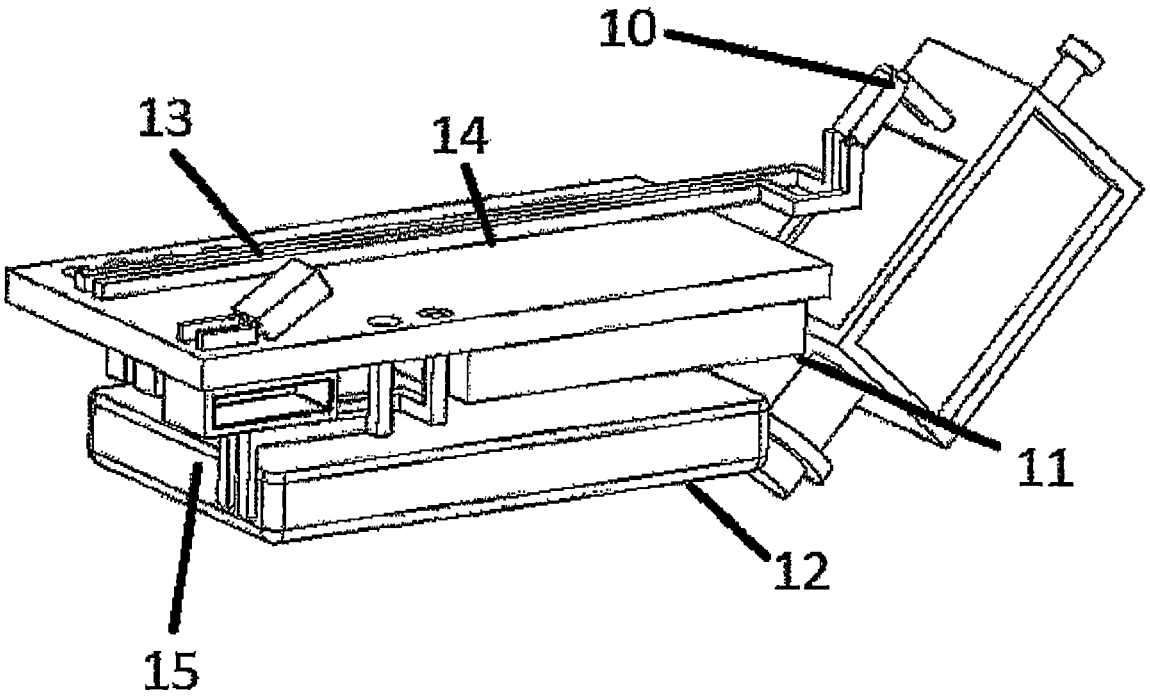
FIG. 5 depicts main electronic parts of the device.
Figure 6:
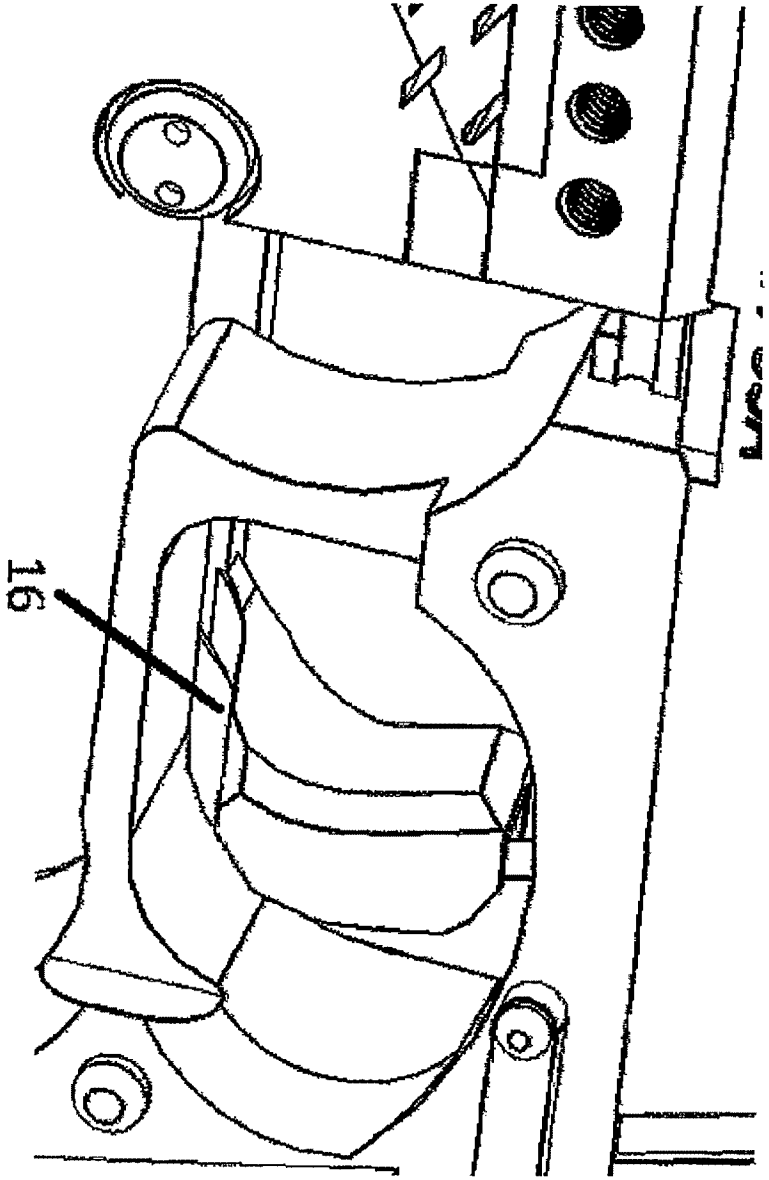
FIG. 6 slide of the device covering a firearms trigger.
Figure 7:
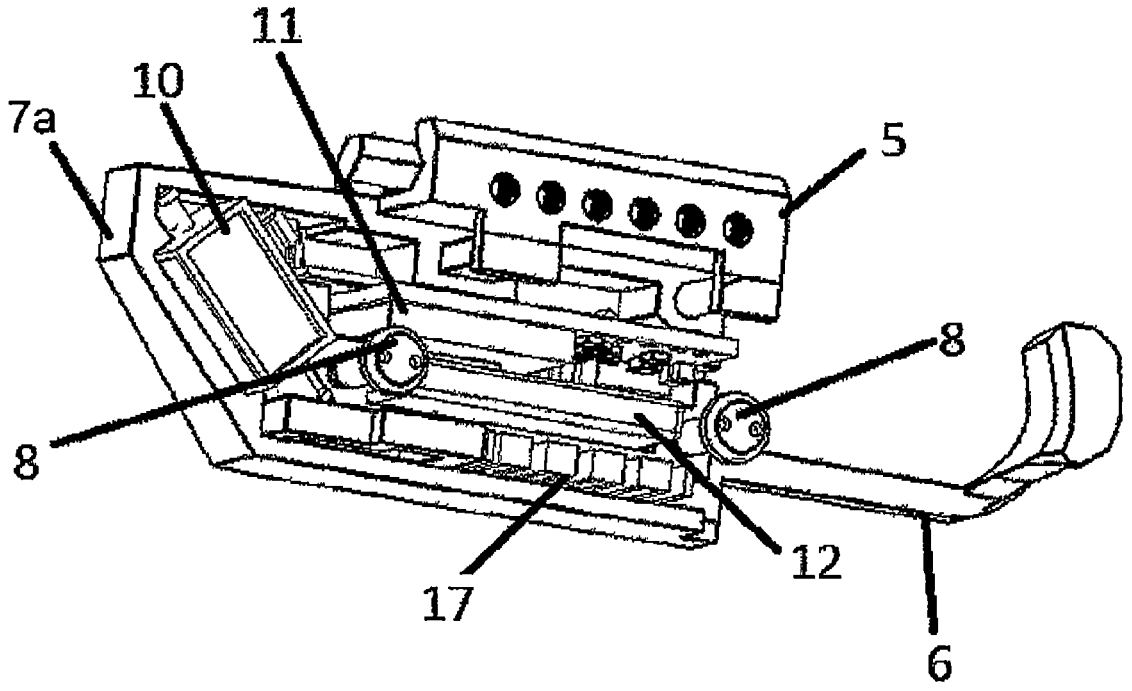
FIG. 7 depicts internal components of the device.

The device 1 consists of two pieces of casing consisting of two pieces 7*a*, 7*b* (FIGS. 1, 3, 4 and 7). A slide 6 is placed in the lower level of the casing 7, and a spring 17, is placed behind it (FIGS. 3 and 7). A solenoid 10, a battery 12 and a PCB board 14, containing a proximity detector 11, a mercury switch 13 (FIG. 5) are placed inside the casing. Two led lights 9 to show charging and power on state, and USB charging port 15, as well as wiring connecting the battery 12 and solenoid 10 are placed in the second level of the casing 7. Both pieces (7*a*, 7*b* of casing 7, are placed together and screwed into position with two snake eyed security screws 8. A gun rail connector 5 is placed on a single action or striker-fired hand gun rail. The casing that is screwed together is then slid onto the gun rail connector 5, and is secured and fastened into place using a two eyed security bolt 3. Once the position of the slide 6 is achieved such that it is covering the trigger 16 adequately, the snake eye security screw is fastened in place on the gun rail connector 5, where it connects with the hand guns weaver or picatinny rails slots. To properly operate said device the Bluetooth wrist worn device of FIG. 2 is placed on the hand you draw your gun with.

I claim:

1. A firearm trigger locking accessory comprising: a slide which covers the front of a trigger, the left side of said trigger, the right side of said trigger, said slide only covering the trigger while still allowing access within the said triggers trigger guard; a Bluetooth Low Energy proximity detector, a mercury switch controlling or partly controlling the power supply of said firearm trigger locking accessory, a push pull solenoid to rock and unlock said slide, a spring driven mechanism for moving said slide back into its lockable position after said slide has been moved; said firearm trigger locking accessory capable of mounting to a handgun; said firearm trigger locking accessory capable of mounting a handgun rail accessory.

2. The firearm trigger locking accessory of claim 1 wherein said firearm trigger locking accessory is comprised of said slide which covers the front of said trigger, left side of said trigger, the right side of said trigger while still allowing access within the said triggers trigger guard.

3. The firearm trigger locking accessory of claim 1 wherein said firearm trigger locking accessory is comprised of said slide which covers the front of said trigger, the left of said trigger, the right side of said trigger while still allowing access within the said triggers trigger guard in conjunction with said push pull solenoid as a method of locking and unlocking said slide.

4. The firearm trigger locking accessory of claim 1 wherein said firearm trigger locking accessory is comprised of said Bluetooth Low Energy proximity detector being used in combination with said push pull solenoid and said mercury switch.

5. The firearm trigger locking accessory of claim 1 wherein said firearm trigger locking accessory is comprised of said Bluetooth Low Energy proximity detector being combined with said push pull solenoid and said mercury switch.

6. The firearm trigger locking accessory of claim 1 wherein said firearm trigger locking accessory is comprised of said mercury switch as a means of controlling the power supply of said firearm trigger locking accessory.

7. The firearm trigger locking accessory of claim 1 wherein said firearm trigger locking accessory is comprised of said mercury switch as a means of partly controlling the power supply of said firearm trigger locking accessory.

8. The firearm trigger locking accessory of claim 1 wherein said firearm trigger locking accessory is comprised of said slide which covers the front of said trigger, the left of said trigger, the right side of said trigger while still allowing access within the said triggers trigger guard in conjunction with said Bluetooth Low Energy proximity detector.

9. The firearm trigger looking accessory of claim 1 wherein said firearm trigger locking accessory is comprised of said slide which covers the front of said trigger, the left of said trigger, the right side of said trigger while still allowing access within the said triggers trigger guard in conjunction with said spring driven mechanism.

10. The firearm trigger locking accessory of claim 1 wherein said firearm trigger locking accessory is comprised of said slide which covers the front of said trigger, the left of said trigger, the right side of said trigger while still allowing access within the said triggers trigger guard combined with said Bluetooth Low Energy proximity detector, with said push pull solenoid, said mercury switch, and said spring driven mechanism.

11. The firearm trigger locking accessory of claim 1, wherein said firearm trigger locking accessory is capable of mounting to a handgun.

12. The firearm trigger locking accessory of claim 1 wherein said firearm trigger locking accessory is capable of mounting to a handgun rail accessory.

* * * * *